US010851978B1

(12) United States Patent
Shepherd

(10) Patent No.: US 10,851,978 B1
(45) Date of Patent: Dec. 1, 2020

(54) CHRISTMAS TREE ILLUMINATION ASSEMBLY

(71) Applicant: Laura Shepherd, Waynesfield, OH (US)

(72) Inventor: Laura Shepherd, Waynesfield, OH (US)

( * ) Notice: Subject to any disclaimer, the term of this patent is extended or adjusted under 35 U.S.C. 154(b) by 0 days.

(21) Appl. No.: 16/507,731

(22) Filed: Jul. 10, 2019

(51) Int. Cl.

| | |
|---|---|
| ***F21V 21/32*** | (2006.01) |
| ***F21V 21/088*** | (2006.01) |
| ***F21V 23/06*** | (2006.01) |
| ***A47G 33/08*** | (2006.01) |
| ***A47G 33/10*** | (2006.01) |
| ***F21Y 115/10*** | (2016.01) |
| ***F21W 121/04*** | (2006.01) |
| ***F21Y 103/10*** | (2016.01) |

(52) U.S. Cl.
CPC ..... *F21V 21/32* (2013.01); *A47G 33/08* (2013.01); *A47G 33/10* (2013.01); *F21V 21/088* (2013.01); *F21V 23/06* (2013.01); *F21W 2121/04* (2013.01); *F21Y 2103/10* (2016.08); *F21Y 2115/10* (2016.08)

(58) Field of Classification Search
CPC ..... F21V 21/32; F21V 21/088; F21V 23/06; F21V 21/008; F21V 33/028; F21V 33/0028; A47G 33/10; A47G 33/08; A47G 2033/0827; A47G 33/0863; F21S 4/10; F21S 4/22; F21Y 2115/10; F21Y 2103/10; F21W 2121/04
See application file for complete search history.

(56) References Cited

U.S. PATENT DOCUMENTS

| | | | | |
|---|---|---|---|---|
| 4,118,762 | A | 10/1978 | Fennell | |
| 4,777,571 | A | 10/1988 | Morgan | |
| 4,939,004 | A * | 7/1990 | Fuss | A47G 33/08 362/123 |
| 6,379,021 | B1 * | 4/2002 | Shieh | A47G 33/06 362/123 |
| 6,439,744 | B1 | 8/2002 | Chanslor | |
| 6,811,283 | B1 | 11/2004 | Kovacs | |
| 7,473,024 | B2 | 1/2009 | Gibboney | |
| 8,746,928 | B2 * | 6/2014 | Morris | E04H 12/32 362/249.06 |
| 8,801,227 | B1 * | 8/2014 | Loomis | F21V 21/088 362/249.19 |
| 2001/0043472 | A1 * | 11/2001 | Gibboney, Jr. | F21S 4/20 362/240 |
| 2015/0292696 | A1 | 10/2015 | Soofer | |

* cited by examiner

*Primary Examiner* — Peggy A Neils

(57) ABSTRACT

A Christmas tree illumination assembly includes a tube that is comprised of a flexible material. The tube has a green color for concealing the tube in a Christmas tree. A light emitter is coupled to the tube to emit light outwardly from the tube for illuminating an ornament that is positioned on the top of the Christmas tree. A power cord is coupled to and extends away from the tube. The power cord has a green color for concealing the power cord in the Christmas tree. A clamp is coupled to the power cord. The clamp is biased into a closed position to engage the Christmas tree for retaining the tube at a selected position in the Christmas tree.

5 Claims, 4 Drawing Sheets

CHRISTMAS TREE ILLUMINATION ASSEMBLY

CROSS-REFERENCE TO RELATED APPLICATIONS

Statement Regarding Federally Sponsored Research or Development

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to illumination devices and more particularly pertains to a new illumination device for illuminating the top of a Christmas tree.

BRIEF SUMMARY OF THE INVENTION

An embodiment of the disclosure meets the needs presented above by generally comprising a tube that is comprised of a flexible material. The tube has a green color for concealing the tube in a Christmas tree. A light emitter is coupled to the tube to emit light outwardly from the tube for illuminating an ornament that is positioned on the top of the Christmas tree. A power cord is coupled to and extends away from the tube. The power cord has a green color for concealing the power cord in the Christmas tree. A clamp is coupled to the power cord. The clamp is biased into a closed position to engage the Christmas tree for retaining the tube at a selected position in the Christmas tree.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
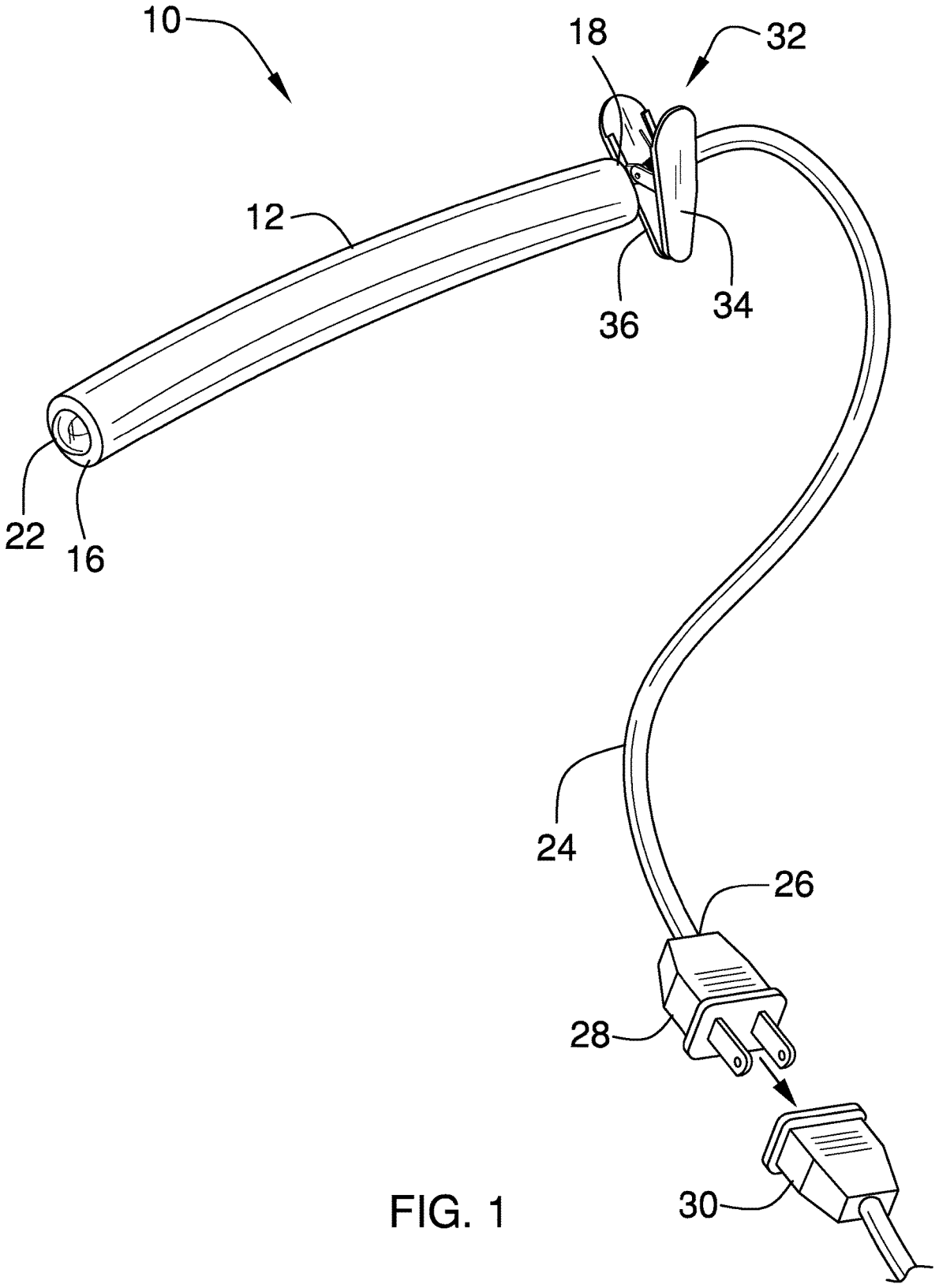
FIG. 1 is a perspective view of a Christmas tree illumination assembly according to an embodiment of the disclosure.
Figure 2:
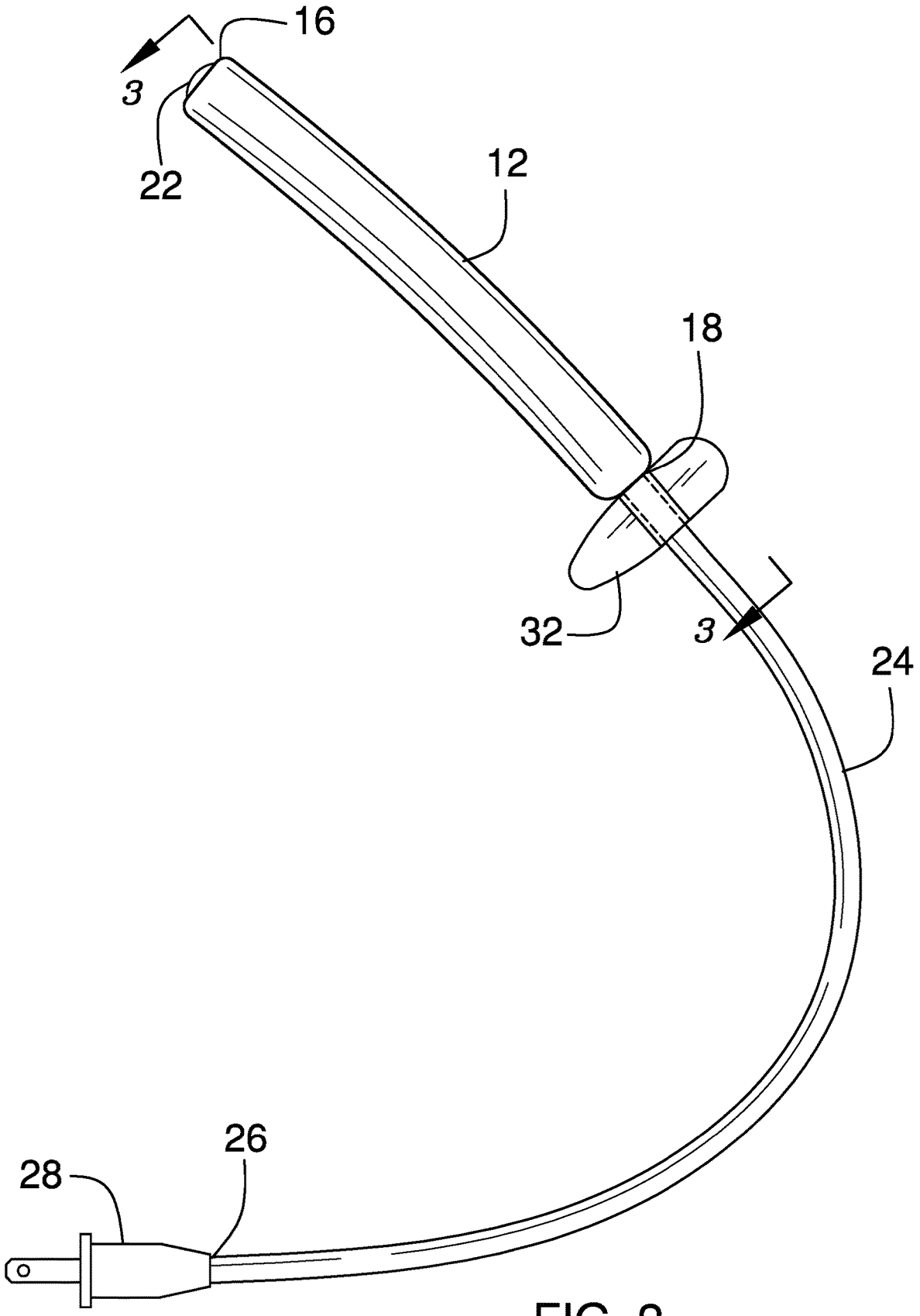
FIG. 2 is a front view of an embodiment of the disclosure.
Figure 3:
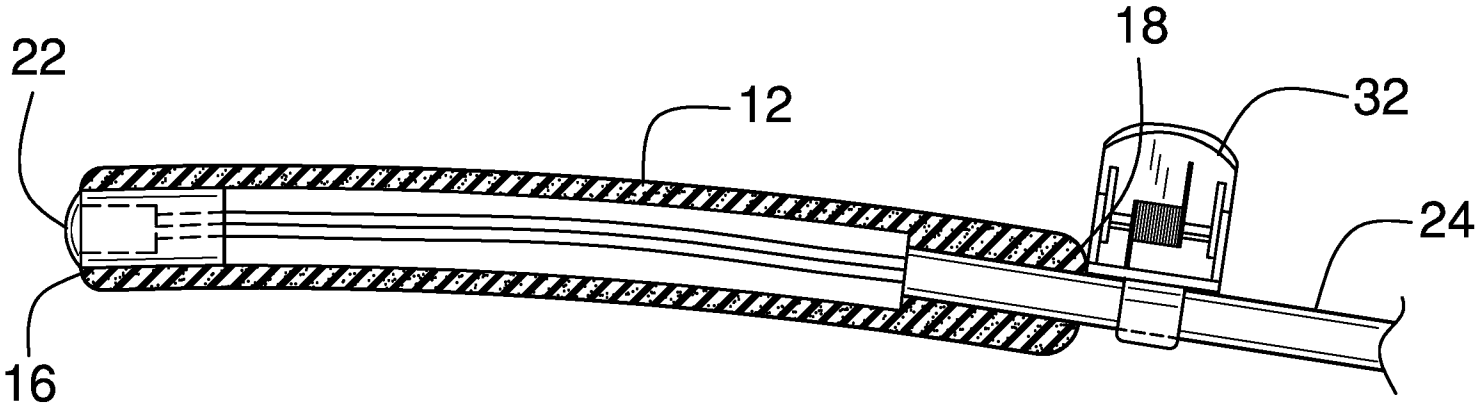
FIG. 3 is a cross sectional view taken along line 3-3 of FIG. 2 of an embodiment of the disclosure.
Figure 4:
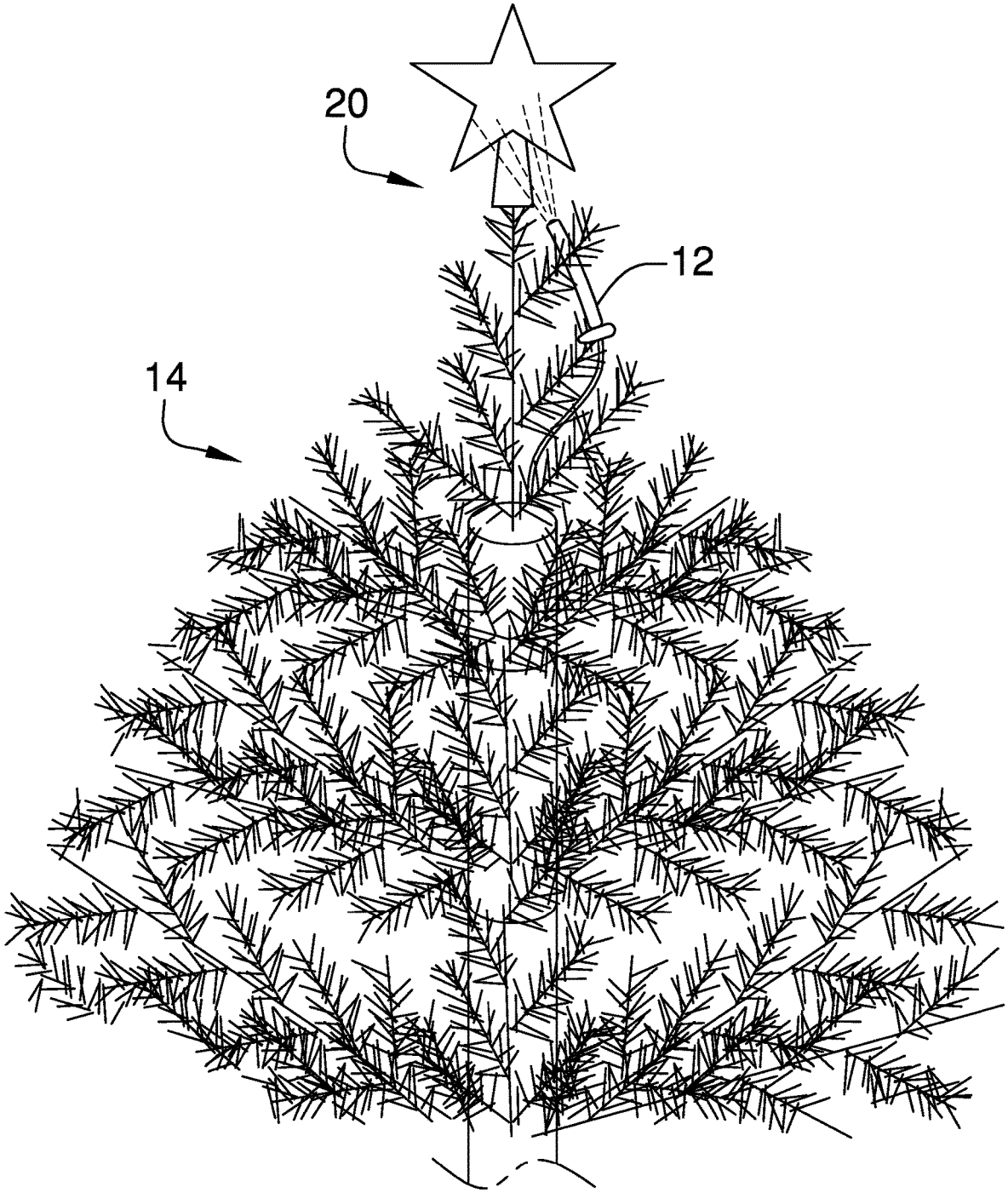
FIG. 4 is a perspective in-use view of an embodiment of the disclosure.

With reference now to the drawings, and in particular to FIGS. 1 through 4 thereof, a new illumination device embodying the principles and concepts of an embodiment of the disclosure and generally designated by the reference numeral 10 will be described.

As best illustrated in FIGS. 1 through 4, the Christmas tree illumination assembly 10 generally comprises a tube 12 that is comprised of a flexible material. Thus, the tube 12 can be shaped into a variety of shapes. Moreover, the tube 12 has a green color such that the tube 12 can be concealed in a Christmas tree 14. The tube 12 has a first end 16 and a second end 18, and the tube 12 is elongated between the first 16 and second 18 ends. The tube 12 is positionable in the Christmas tree 14 having the first end 16 being directed toward a top 20 of the Christmas tree 14.

A light emitter 22 is coupled to the tube 12 to emit light outwardly from the tube 12 for illuminating an ornament that is positioned on the top 20 of the Christmas tree 14. The light emitter 22 is positioned on the first end 16 of the tube 12. Thus, the tube 12 can be bent or shaped in whatever means is necessary to direct the light emitter 22 toward the top 20 of the Christmas tree 14. The light emitter 22 may comprise an LED or other electronic light emitter 22.

A power cord 24 is coupled to and extends away from the tube 12. Additionally, the power cord 24 has a green color such that the power cord 24 can be concealed in the Christmas tree 14. The power cord 24 is electrically coupled to the light emitter 22 and the power cord 24 has a distal end 26 with respect to the second end 18 of the tube 12. The distal end 26 has a male electrical plug 28 electrically coupled thereto. The male electrical plug 28 can be plugged into a female electrical outlet 30, such as an extension cord or an outlet on a string of Christmas lights.

A clamp 32 is coupled to the power cord 24 and the clamp 32 is biased into a closed position for engaging the Christmas tree 14. In this way the clamp 32 can retain the tube 12 at a selected position in the Christmas tree 14. The clamp 32 is positioned adjacent to the second end 18 of the tube 12. The clamp 32 comprises a first member 34 that is pivotally coupled to a second member 36. The first 34 and second 36 members are biased toward each other for engaging the Christmas tree 14.

In use, the tube 12 is positioned at a selected spot in the Christmas tree 14 and the clamp 32 is manipulated to engage the Christmas tree 14. The tube 12 is bent or shaped to direct the light emitter 22 toward the top 20 end of the Christmas tree 14. In this way an ornament that is positioned on top 20 of the Christmas tree 14 can be illuminated from within the Christmas tree 14. The male electrical plug 28 on the power cord 24 is plugged into the female electrical outlet 30 to turn the light emitter 22 on. Additionally, the green coloring of the tube 12 and the power cord 24 facilitates the tube 12 and the power cord 24 to be concealed in the Christmas tree 14.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A Christmas tree illumination assembly being configured to be positioned to illuminate a Christmas tree topper, said assembly comprising:

a tube being comprised of a flexible material, said tube having a green color wherein said tube is configured to be concealed in a Christmas tree, said tube having a circular cross-sectional shape perpendicular to a longitudinal axis of said tube;

a light emitter being coupled to said tube wherein said light emitter is configured to emit light outwardly from said tube for illuminating an ornament being positioned on the top of the Christmas tree;

a power cord being coupled to and extending away from said tube, said power cord having a green color wherein said power cord is configured to be concealed in the Christmas tree, said power cord being electrically coupled to said light emitter; and a clamp being coupled to said power cord, said clamp being biased into a closed position wherein said clamp is configured to engage the Christmas tree for retaining said tube at a selected position in the Christmas tree.

2. The assembly according to claim 1, wherein:

said tube has a first end and a second end, said tube being elongated between said first and second ends, said tube being positionable in the Christmas tree having said first end being directed toward a top of the Christmas tree; and said light emitter is positioned on said first end of said tube.

3. The assembly according to claim 2, wherein said power cord has a distal end with respect to said second end of said tube, said distal end having a male electrical plug being electrically coupled to said distal end wherein said male electrical plug is configured to be plugged into a female electrical outlet.

4. The assembly according to claim 2, wherein said clamp is positioned adjacent to said second end of said tube, said clamp comprising a first member being pivotally coupled to a second member, said first and second members being biased toward each other for engaging the Christmas tree.

5. A Christmas tree illumination assembly being configured to be positioned to illuminate a Christmas tree topper, said assembly comprising:

a tube being comprised of a flexible material, said tube having a green color wherein said tube is configured to be concealed in a Christmas tree, said tube having a first end and a second end, said tube being elongated between said first and second ends, said tube having a circular cross-sectional shape perpendicular to a longitudinal axis of said tube, said tube being positionable in the Christmas tree having said first end being directed toward a top of the Christmas tree;

a light emitter being coupled to said tube wherein said light emitter is configured to emit light outwardly from said tube for illuminating an ornament being positioned on the top of the Christmas tree, said light emitter being positioned on said first end of said tube;

a power cord being coupled to and extending away from said tube, said power cord having a green color wherein said power cord is configured to be concealed in the Christmas tree, said power cord being electrically coupled to said light emitter, said power cord having a distal end with respect to said second end of said tube, said distal end having a male electrical plug being electrically coupled to said distal end wherein said male electrical plug is configured to be plugged into a female electrical outlet; and a clamp being coupled to said power cord, said clamp being biased into a closed position wherein said clamp is configured to engage the Christmas tree for retaining said tube at a selected position in the Christmas tree, said clamp being positioned adjacent to said second end of said tube, said clamp comprising a first member being pivotally coupled to a second member, said first and second members being biased toward each other for engaging the Christmas tree.

* * * * *